US008451176B2

(12) United States Patent
Biswas et al.

(10) Patent No.: US 8,451,176 B2
(45) Date of Patent: May 28, 2013

(54) METHOD FOR ACHIEVING INTRINSIC SAFETY COMPLIANCE IN WIRELESS DEVICES USING ISOLATED OVERLAPPING GROUNDS AND RELATED APPARATUS

(75) Inventors: Gourango Biswas, Bangalore (IN); Cyril A. A. Emmanuel, Bangalore (IN)

(73) Assignee: Honeywell International Inc., Morristown, NJ (US)

( * ) Notice: Subject to any disclaimer, the term of this patent is extended or adjusted under 35 U.S.C. 154(b) by 652 days.

(21) Appl. No.: 12/637,379

(22) Filed: Dec. 14, 2009

(65) Prior Publication Data

US 2010/0315298 A1 Dec. 16, 2010

Related U.S. Application Data

(60) Provisional application No. 61/186,253, filed on Jun. 11, 2009.

(51) Int. Cl.
*H01Q 1/24* (2006.01)
*H01P 11/00* (2006.01)

(52) U.S. Cl.
USPC ..... 343/700 MS; 343/702; 343/846; 29/600

(58) Field of Classification Search
USPC . 343/700 MS, 702, 846; 333/33, 238; 29/600
See application file for complete search history.

(56) References Cited

U.S. PATENT DOCUMENTS

| | | | |
|---|---|---|---|
| 3,446,975 | A | 5/1969 | Adler et al. |
| 4,096,456 | A | 6/1978 | Coussot et al. |
| 5,146,234 | A | 9/1992 | Lalezari |
| 5,164,738 | A | 11/1992 | Walter et al. |
| 5,220,188 | A | 6/1993 | Higashi et al. |
| 5,449,910 | A | 9/1995 | Wood et al. |
| 5,469,170 | A | 11/1995 | Mariani |
| 5,534,111 | A | 7/1996 | Hocker et al. |
| 5,895,233 | A | 4/1999 | Higashi et al. |
| 6,036,872 | A | 3/2000 | Wood et al. |
| 6,249,255 | B1 | 6/2001 | Eggleston |
| 6,316,770 | B1 | 11/2001 | Ouvrier-Buffet et al. |
| 6,329,655 | B1 | 12/2001 | Jack et al. |

(Continued)

FOREIGN PATENT DOCUMENTS

| | | | |
|---|---|---|---|
| WO | WO 2008024411 | A2 * | 2/2008 |
| WO | WO2008069493 | A1 | 6/2008 |

OTHER PUBLICATIONS

Robert Higashi, et al., "Transducer for High-Frequency Antenna Coupling and Related Apparatus and Method", U.S. Appl. No. 12/052,419, filed Mar. 20, 2008.

(Continued)

*Primary Examiner* — Dieu H Duong

(57) ABSTRACT

A system includes a wireless radio board, an antenna, and a ground pattern having a radio board ground and an antenna ground. At least a portion of the radio board ground and at least a portion of the antenna ground overlap. The radio board ground could include a first portion in a first layer of the ground pattern and a second portion in a second layer of the ground pattern, and the antenna ground could include a first portion in the first layer of the ground pattern. The antenna ground could further include a second portion in the second layer of the ground pattern. The radio board and antenna grounds could be separated by a minimum distance, such as 0.5 mm or 3.0 mm.

20 Claims, 4 Drawing Sheets

U.S. PATENT DOCUMENTS

| | | | | |
|---|---|---|---|---|
| 6,842,158 | B2 | 1/2005 | Jo et al. | |
| 2002/0000938 | A1 * | 1/2002 | Hoashi et al. | 343/700 MS |
| 2004/0140429 | A1 | 7/2004 | Jack et al. | |
| 2004/0150563 | A1 | 8/2004 | Oshiyama et al. | |
| 2005/0253758 | A1 | 11/2005 | Il et al. | |
| 2005/0253761 | A1 | 11/2005 | Tung | |
| 2006/0081781 | A1 | 4/2006 | Bluzer | |
| 2007/0146720 | A1 | 6/2007 | Cox et al. | |
| 2007/0278407 | A1 | 12/2007 | Wood et al. | |

OTHER PUBLICATIONS

E N. Grossman, et al., "Terahertz Active Direct Detection Imagers", Quantum Electrical Metrology Division, National Institute of Standards and Technology, Proceedings of SPIE, vol. 5411, Sep. 2004, p. 68-77.

* cited by examiner

METHOD FOR ACHIEVING INTRINSIC SAFETY COMPLIANCE IN WIRELESS DEVICES USING ISOLATED OVERLAPPING GROUNDS AND RELATED APPARATUS

CROSS-REFERENCE TO RELATED APPLICATIONS

This application claims priority under 35 U.S.C. §119(e) to U.S. Provisional Application No. 61/186,253 filed on Jun. 11, 2009, which is hereby incorporated by reference.

TECHNICAL FIELD

This disclosure relates generally to wireless devices. More specifically, this disclosure relates to a method for achieving intrinsic safety compliance in wireless devices using isolated overlapping grounds and related apparatus.

BACKGROUND

In industrial process control systems, wireless networks have been widely deployed to support sensing and monitoring of industrial processes. These networks allow industrial processes to be monitored using wireless sensors without incurring the costs typically associated with wired devices. However, wireless sensors often need to be compliant with intrinsic safety standards in order to be used in certain applications. For example, wireless sensors may be required to satisfy a "zone 2" (intrinsic safety) or "zone 0" (highly hazardous) level of certification.

Often times, wireless sensors include radio frequency (RF) or other wireless radio boards, along with external antennas for better range performance. For a device to be intrinsically safe, a common constraint is that the antenna's ground and the radio board's ground are to be completely isolated by certain distances (approximately 0.5 mm for "zone 2" and approximately 3.0 mm for "zone 0"). Unfortunately, this type of arrangement disturbs the matching between the antennas and the radio boards, causing high RF or other losses due to ground discontinuities.

Normally, for lower RF frequencies (such as those operating at VHF bands), the grounds can be isolated using high-voltage coupling capacitors between the grounds. However, this approach typically cannot be used with higher frequencies (such as those greater than 1 GHz), which are very sensitive to grounding discontinuities. This approach also typically causes reductions in the transmit power and receiver sensitivity of the wireless sensors, such as by reducing the transmit power by approximately 3 dB. This affects the free space range of the wireless sensors and their reliability (which is often a major requirement for wireless sensor networks). In addition, since wireless sensors are often battery-powered devices, the reductions in transmit power and receiver sensitivity often require the wireless sensors to consume more battery power during operation, which reduces the operational lifetimes of the wireless sensors.

SUMMARY

This disclosure provides a method for achieving intrinsic safety compliance in wireless devices using isolated overlapping grounds and related apparatus.

In a first embodiment, an apparatus includes a wireless radio board, an antenna, and a ground pattern having a radio board ground and an antenna ground. At least a portion of the radio board ground and at least a portion of the antenna ground overlap. The radio board ground could include a first portion in a first layer of the ground pattern and a second portion in a second layer of the ground pattern, and the antenna ground could include a first portion in the first layer of the ground pattern. The antenna ground could further include a second portion in the second layer of the ground pattern. Portions of the radio board and antenna grounds could be separated by a minimum distance, such as 0.5 mm or 3.0 mm.

In a second embodiment, a system includes one or more wireless devices. At least one of the wireless devices includes a wireless radio board, an antenna, and a ground pattern having a radio board ground and an antenna ground. At least a portion of the radio board ground and at least a portion of the antenna ground overlap.

In a third embodiment, a method includes forming a radio board ground in a ground pattern and forming an antenna ground in the ground pattern. At least a portion of the radio board ground and at least a portion of the antenna ground overlap.

Other technical features may be readily apparent to one skilled in the art from the following figures, descriptions, and claims.

BRIEF DESCRIPTION OF THE DRAWINGS

For a more complete understanding of this disclosure, reference is now made to the following description, taken in conjunction with the accompanying drawings, in which.

DETAILED DESCRIPTION

FIGS. 1 through 6, discussed below, and the various embodiments used to describe the principles of the present invention in this patent document are by way of illustration only and should not be construed in any way to limit the scope of the invention. Those skilled in the art will understand that the principles of the invention may be implemented in any type of suitably arranged device or system.

Figure 1:
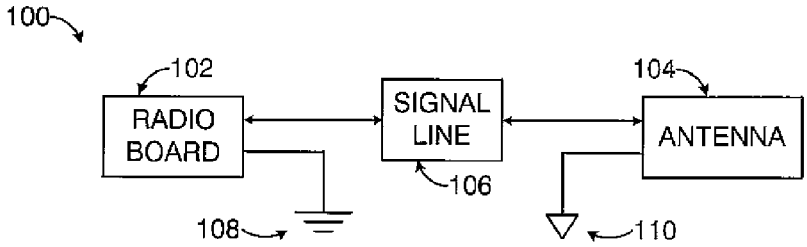
FIG. 1 illustrates an example layout in a wireless sensor or other wireless device according to this disclosure.

FIG. 1 illustrates an example layout 100 in a wireless sensor or other wireless device according to this disclosure. As shown in FIG. 1, the layout 100 includes a radio board 102 coupled to an antenna 104 via a signal line 106. The radio board 102 represents any suitable circuitry or other structure that transmits signals to and/or receives signals from the antenna 104. The radio board 102 could, for example, represent a radio frequency (RF) transmitter, RF receiver, or RF transceiver. The antenna 104 represents any suitable structure for transmitting and/or receiving wireless signals, such as an RF antenna. Note that any other suitable wireless signals could be used to communicate. The signal line 106 represents any suitable structure electrically coupling the radio board 102 to the antenna 104. As shown in FIG. 1, the radio board 102 and the antenna 104 operate using separate grounds 108-110, respectively.

In accordance with this disclosure, a technique is provided for reducing or minimizing RF or other wireless losses at an interface between the wireless radio board 102 and the antenna 104, while simultaneously satisfying any relevant intrinsic safety compliance standards. This is achieved by arranging the grounds 108-110 to have an overlapping structure. This type of layout helps to suppress RF or other leakage even with ground discontinuities, while simultaneously providing better impedance matching for seamless interfacing to the antenna 104. This approach provides improved transmit power losses (such as less than 1 dB), improved receiver sensitivities, and longer battery lives.

Any suitable intrinsic safety compliance standards could be used here. The "zone 2" level of intrinsic safety compliance is less stringent than the "zone 0" level of intrinsic safety compliance. The "zone 2" level of intrinsic safety compliance typically needs the antenna ground 110 and the radio board ground 108 to be completely isolated, where the minimum distance required between the two grounds 108-110 is approximately 0.5 mm. The "zone 0" level of intrinsic safety compliance is more stringent and typically needs the antenna ground 110 and the radio board ground 108 to be completely isolated, where the minimum distance required between the two grounds 108-110 is approximately 3.0 mm.

Example ground patterns with overlapping structures are shown in FIGS. 2A through 3B, which are described below. These ground patterns are for illustration only. Other ground patterns that use overlapping structures and support intrinsic safety standards could also be used.

Although FIG. 1 illustrates one example of a layout 100 in a wireless sensor or other wireless device, various changes may be made to FIG. 1. For example, a wireless sensor or other wireless device could include any number of radio boards, signal lines, and antennas.

Figure 2A:
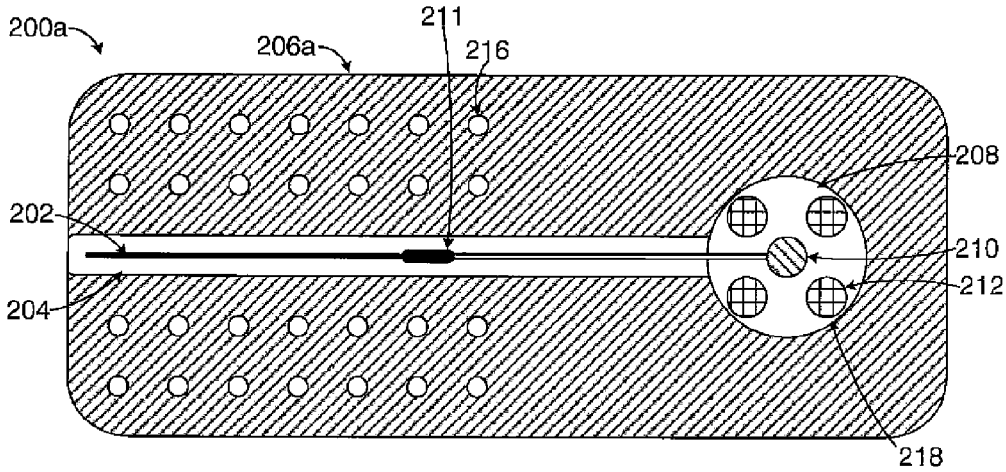
FIGS. 2A and 2B illustrate a first example ground pattern for a wireless sensor or other wireless device according to this disclosure.
Figure 2B:
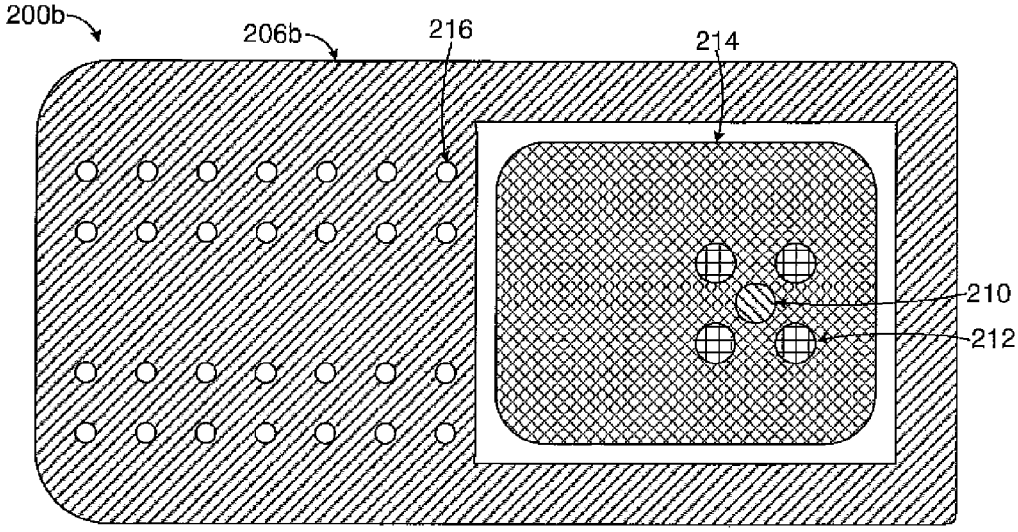

FIGS. 2A and 2B illustrate a first example ground pattern for a wireless sensor or other wireless device according to this disclosure. FIG. 2A illustrates one layer 200*a* (such as an upper layer) of the ground pattern, while FIG. 2B illustrates another layer 200*b* (such as a lower layer) of the ground pattern. The layers 200*a*-200*b* are stacked such that common components in FIGS. 2A and 2B align.

As shown in FIG. 2A, the layer 200*a* includes a signal trace 202, which represents a signal line carrying RF or other signals between a radio board and an antenna. The signal trace 202 travels in a channel 204 formed in a first portion 206*a* of a radio board ground to a circular cavity 208. The radio board ground represents a structure used to ground the radio board 102. The cavity 208 contains an antenna connector 210 coupled to the signal line 202, optionally through a capacitor 211. The cavity 208 also contains projections 212 from an antenna ground 214, which represents a structure used to ground the antenna 104 and is shown in FIG. 2B. The radio board ground 206*a* includes various vias 216 that can be plated or filled with conductive material(s) to electrically couple the portion 206*a* of the radio board ground in one layer 200*a* to another portion 206*b* of the radio board ground in the other layer 200*b*.

As shown in FIG. 2B, the antenna ground 214 includes the projections 212 that project through the cavity 208 in the other layer 200*a*. By stacking the layers 200*a*-200*b* of the ground pattern, the radio board ground 206*a* in the layer 200*a* spreads out and over the antenna ground 214 in the other layer 200*b* of the ground pattern. As a result, the radio board and antenna grounds actually overlap in the two layers 200*a*-200*b*.

This technique for coupling the radio board ground in one layer 200*a* over the antenna ground in the other layer 200*b* can reduce or minimize RF or other leakage and reduce losses to less than 0.5 dB even in higher frequencies. Also, the layout shown in FIGS. 2A and 2B can provide a matching performance greater than 15 dB with lower insertion losses. This helps to reduce or avoid resonances forming within the wireless band and affecting wireless performance. In addition, the projections 212 of the antenna ground 214 and the portion 206*a* of the radio board ground can be separated by a gap 218 having some minimum distance, such as 0.5 mm. As a result, a "zone 2" level of intrinsic safety compliance can be obtained using the overlapping structure shown in FIGS. 2A and 2B.

Note that the use of RF signals is for illustration only. Also note that each ground (radio board and antenna) could be formed from any suitable material(s), such as one or more metals or other conductive materials. Further note that the size and shape of each ground in each layer 200*a*-200*b* are for illustration only. In addition, note that the number of vias 216 in the radio board ground 206*a*-206*b* and the number of projections 212 in the antenna ground 214 are for illustration only.

Although FIGS. 2A and 2B illustrate a first example ground pattern for a wireless sensor or other wireless device, various changes may be made to FIGS. 2A and 2B. For example, other ground patterns having overlapping radio board and antenna grounds with some minimum spacing could also be used.

Figure 3A:
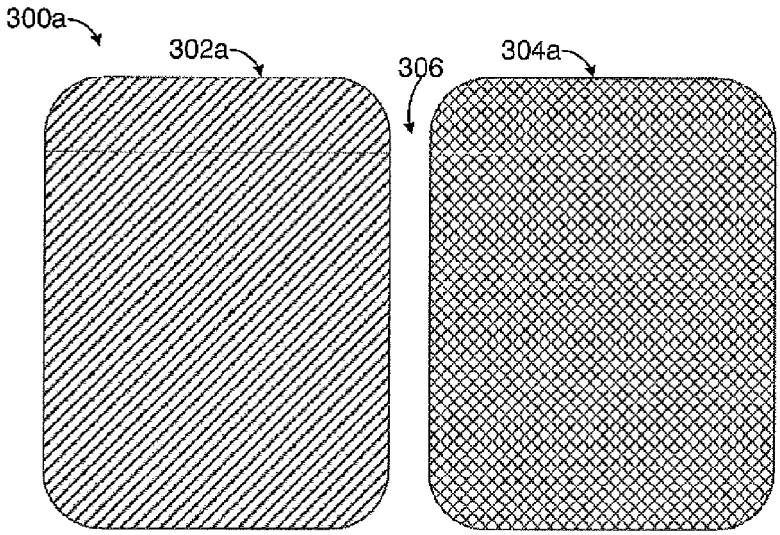
FIGS. 3A and 3B illustrate a second example ground pattern for a wireless sensor or other wireless device according to this disclosure.
Figure 3B:
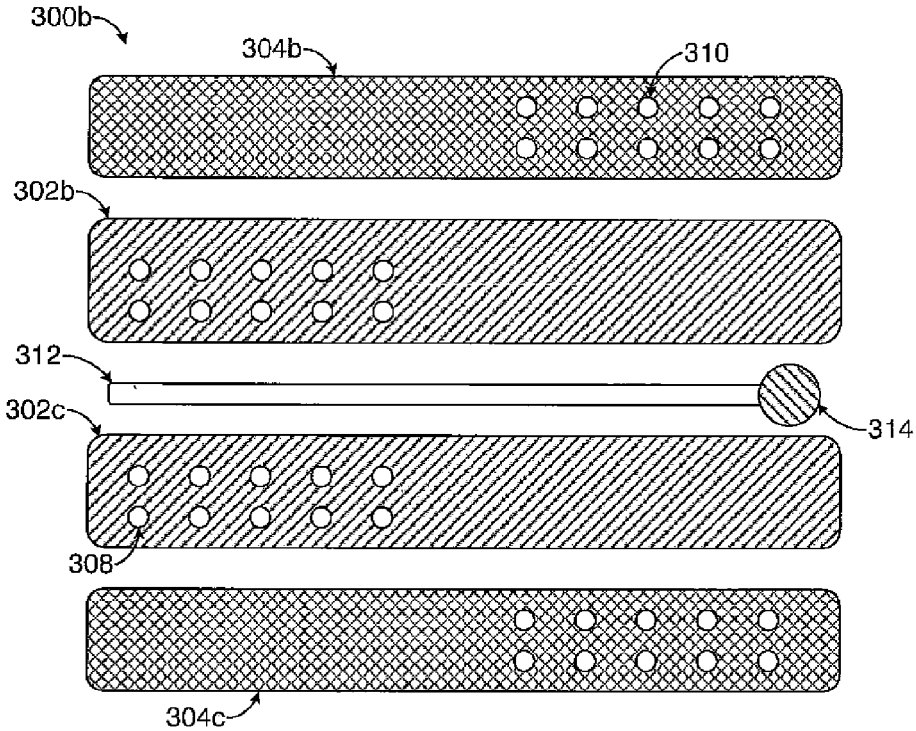

FIGS. 3A and 3B illustrate a second example ground pattern for a wireless sensor or other wireless device according to this disclosure. FIG. 3A illustrates one layer 300*a* (such as a lower layer) of the ground pattern, while FIG. 3B illustrates another layer 300*b* (such as an upper layer) of the ground pattern. The layers 300*a*-300*b* are stacked such that common components in FIGS. 3A and 3B align.

As shown in FIG. 3A, the layer 300*a* includes a first portion 302*a* of a radio board ground and a first portion 304*a* of an antenna ground. These portions 302*a* and 304*b* are generally rectangular-shaped ground planes. The ground planes are separated by a gap 306.

As shown in FIG. 3B, the layer 300*b* includes various strips 302*b*-302*c* and 304*b*-304*c*, where each strip is positioned over both ground planes 302*a* and 304*a* in the other layer 300*a*. Each strip 302*b*-302*c* is coupled to the ground plane 302*a* in the other layer 300*a* using vias 308, and each strip 304*b*-304*c* is coupled to the ground plane 304*a* in the other layer 300*a* using vias 310. The vias 308-310 can be plated or filled with conductive material(s) to electrically couple the layers 300*a*-300*b* of the ground pattern.

In this example, the two outer strips 304*b*-304*c* are coupled to the antenna ground plane 304*a*, while the two inner strips 302*b*-302*c* are coupled to the radio board ground plane 302*a*. A signal trace 312 is positioned between the two inner strips 302*b*-302*c*, and the signal trace 312 is coupled to an antenna connector 314.

Once again, the radio board and antenna grounds actually overlap in the two layers 300*a*-300*b* of the ground pattern shown in FIGS. 3A and 3B. This layout can suppress RF or other wireless signal leakage from any ground discontinuity of the layer 300*a*. This overlapping structure helps in channeling the RF or other signal flow across the signal line 312 even though there is a discontinuity in the ground plane as shown in FIGS. 3A and 3B. This type of layout can provide a matching performance greater than 12 dB and can reduce insertion losses to less than 1 dB even for higher frequencies. This helps to reduce or avoid resonances forming within the wireless band and affecting wireless performance. This type of layout can further provide better matching performance and insertion losses even though the separation of the grounds is larger. In addition, the grounds 302*a* and 304*a* can be separated by some minimum distance, such as approximately 3.0 mm. As a result, a "zone 0" level of intrinsic safety compliance can be obtained using the overlapping structure shown in FIGS. 3A and 3B.

Note that the use of RF signals in FIGS. 3A and 3B is for illustration only. Also note that each ground (radio board and antenna) could be formed from any suitable material(s), such as one or more metals or other conductive materials. Further note that the size and shape of each ground in each layer 300*a*-300*b* are for illustration only. In addition, note that the numbers of vias in the radio board and antenna grounds are for illustration only.

Although FIGS. 3A and 3B illustrate a second example ground pattern for a wireless sensor or other wireless device, various changes may be made to FIGS. 3A and 3B. For example, other ground patterns having overlapping radio board and antenna grounds with some minimum spacing could also be used.

These types of grounding layouts as shown in FIGS. 2A through 3B have lower losses and are achievable without increasing the transmit power of the wireless sensors or other wireless devices. At the same time, these grounding layouts can satisfy the relevant intrinsic safety compliance standards. While these ground patterns have been described with reference to specific intrinsic safety compliance standards, the same or similar ground patterns could be used with other compliance standards.

Figure 4:
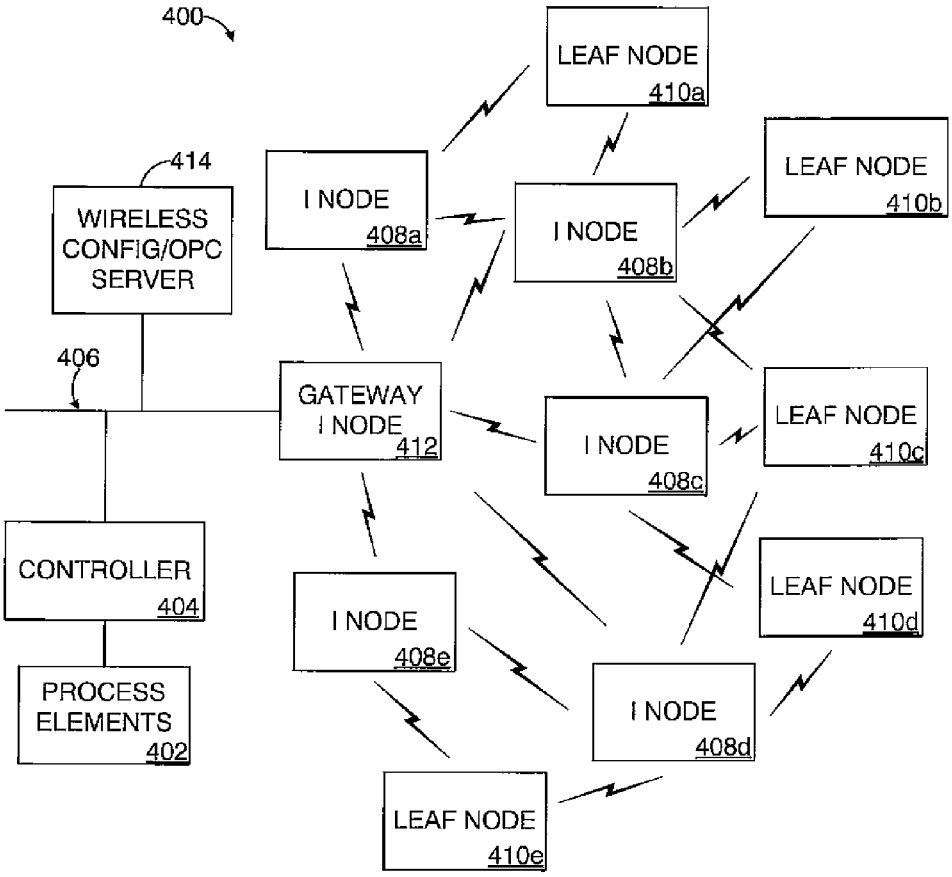
FIG. 4 illustrates an example process control system supporting wireless devices that use isolated overlapping grounds according to this disclosure.

FIG. 4 illustrates an example process control system 400 supporting wireless devices that use isolated overlapping grounds according to this disclosure. In this example embodiment, the process control system 400 includes one or more process elements 402. The process elements 402 represent components in a process system that perform any of a wide variety of functions. For example, the process elements 402 could represent sensors, actuators, or any other or additional industrial equipment in a processing environment. Each process element 402 includes any suitable structure for performing one or more functions in a process system. Also, a process system may represent any system or portion thereof configured to process one or more materials in some manner.

A controller 404 is coupled to the process elements 402. The controller 404 controls the operation of one or more of the process elements 402. For example, the controller 404 could receive information associated with the process system, such as sensor measurements from some of the process elements 402. The controller 404 could use this information to provide control signals to others of the process elements 402, thereby adjusting the operation of those process elements 402. The controller 404 includes any hardware, software, firmware, or combination thereof for controlling one or more process elements 402. The controller 404 could, for example, represent a computing device executing a MICROSOFT WINDOWS operating system.

A network 406 facilitates communication between various components in the system 400. For example, the network 406 may communicate Internet Protocol (IP) packets, frame relay frames, Asynchronous Transfer Mode (ATM) cells, or other suitable information between network addresses. The network 406 may include one or more local area networks, metropolitan area networks, wide area networks (WANs), all or a portion of a global network, or any other communication system or systems at one or more locations.

In FIG. 4, the process control system 400 also includes one or more wireless networks for communicating with wireless sensors or other devices. In this example, a wireless network includes infrastructure nodes ("I nodes") 408*a*-408*e*, leaf nodes 410*a*-410*e*, and a gateway infrastructure node 412.

The infrastructure nodes 408*a*-408*e* and the leaf nodes 410*a*-410*e* engage in wireless communications with each other. For example, the infrastructure nodes 408*a*-408*e* may receive data transmitted over the network 406 (via the gateway infrastructure node 412) and wirelessly communicate the data to the leaf nodes 410*a*-410*e*. Similarly, the leaf nodes 410*a*-410*e* may wirelessly communicate data to the infrastructure nodes 408*a*-408*e* for forwarding to the network 406 (via the gateway infrastructure node 412). In addition, the infrastructure nodes 408*a*-408*e* may wirelessly exchange data with one another.

In this example, the nodes 408*a*-408*e* and 410*a*-410*e* are divided into infrastructure nodes and leaf nodes. The infrastructure nodes 408*a*-408*e* typically represent routing devices that can store and forward messages for other devices. Infrastructure nodes 408*a*-408*e* are typically line-powered devices, meaning these nodes receive operating power from an external source. Infrastructure nodes 408*a*-408*e* are typically not limited in their operations since they need not minimize power consumption to increase the operational life of their internal power supplies. On the other hand, the leaf nodes 410*a*-410*e* are generally non-routing devices that do not store and forward messages for other devices (although they could). Leaf nodes 410*a*-410*e* typically represent devices powered by local power supplies, such as nodes that receive operating power from internal batteries or other internal power supplies. Leaf nodes 410*a*-410*e* are often more limited in their operations in order to help preserve the operational life of their power supplies.

The nodes 408*a*-408*e* and 410*a*-410*e* include any suitable structures facilitating wireless communications, such as RF frequency-hopping spread spectrum (FHSS) or direct sequence spread spectrum (DSSS) transceivers. The nodes 408*a*-408*e* and 410*a*-410*e* could also include other functionality, such as functionality for generating or using data communicated over the wireless network. For example, the leaf nodes 410*a*-410*e* could represent wireless sensors used to measure various characteristics within an industrial facility. The sensors could collect and communicate sensor readings to the controller 404 via the wireless network. The leaf nodes 410*a*-410*e* could also represent actuators that receive control signals from the controller 404 and adjust the operation of the industrial facility. In this way, the leaf nodes may include or operate in a similar manner as the process elements 402 physically connected to the controller 404. The leaf nodes 410*a*-410*e* could further represent handheld user devices (such as INTELATRAC devices from HONEYWELL INTERNATIONAL INC.), mobile stations, programmable logic controllers, or any other or additional devices. The infrastructure nodes 408*a*-408*e* may also include any of the functionality of the leaf nodes 410*a*-410*e* or the controller 404.

The gateway infrastructure node 412 communicates wirelessly with, transmits data to, and receives data from one or more infrastructure nodes and possibly one or more leaf nodes. In this way, the infrastructure nodes 408*a*-408*e*, 412 form a wireless network capable of providing wireless coverage to leaf nodes and other devices in a specified area, such as a large industrial complex. The gateway infrastructure node 412 may also convert data between protocol(s) used by the network 406 and protocol(s) used by the nodes 408*a*-408*e* and 410*a*-410*e*. For example, the gateway infrastructure node 412 could convert Ethernet-formatted data transported over the network 406 into a wireless protocol format (such as an IEEE 802.11a, 802.11b, 802.11g, 802.11n, 802.15.3, 802.15.4, or 802.16 format) used by the nodes 408*a*-408*e* and 410*a*-410*e*. The gateway infrastructure node 412 could also convert data received from one or more of the nodes 408*a*-408*e* and 410*a*-410*e* into Ethernet-formatted data for transmission over the network 406. In addition, the gateway infrastructure node 412 could support various functions, such as network creation and security, used to create and maintain a wireless network. The gateway infrastructure node 412 includes any suitable structure for facilitating communication between components or networks using different protocols.

A wireless configuration and OLE for Process Control (OPC) server 414 can configure and control various aspects of the process control system 400. For example, the server 414 could configure the operation of the nodes 408*a*-408*e*, 410*a*-410*e*, and 412. The server 414 could also support security in the process control system 400, such as by distributing cryptographic keys or other security data to various components in the process control system 400 (like the nodes 408*a*-408*e*, 410*a*-410*e*, and 412). The server 414 includes any hardware, software, firmware, or combination thereof for configuring wireless networks and providing security information.

In particular embodiments, the various nodes in the wireless network of FIG. 4 form a mesh network communicating at 2.4 GHz or 5.8 GHz. Also, in particular embodiments, data can be injected into the wireless mesh network through the infrastructure nodes or leaf nodes, thus providing versatile, multifunctional, plant-wide coverage for wireless sensing, asset location tracking, personnel tracking, wireless communications, and any other or additional functionality as desired.

In one aspect of operation, the infrastructure nodes 408*a*-408*e*, 412 and/or the leaf nodes 410*a*-410*e* could use one or more of the ground patterns described and illustrated above. This may allow the wireless nodes in the system 400 to communicate using lower transmit powers and/or to have better receiver sensitivities. This may also allow the wireless nodes to satisfy any intrinsic safety compliance standards associated with the system 400.

Although FIG. 4 illustrates one example of a process control system 400, various changes may be made to FIG. 4. For example, the process control system 400 could include any number of process elements, controllers, networks (wired or wireless), infrastructure nodes (gateway or other), leaf nodes, and servers. Also, the functional division shown in FIG. 4 is for illustration only. Various components in FIG. 4 could be combined, subdivided, or omitted and additional components could be added according to particular needs. In addition, FIG. 4 illustrates one example operational environment where the ground patterns described and illustrated above can be used. The ground patterns described and illustrated above could be used with any suitable device or system.

Figure 5:
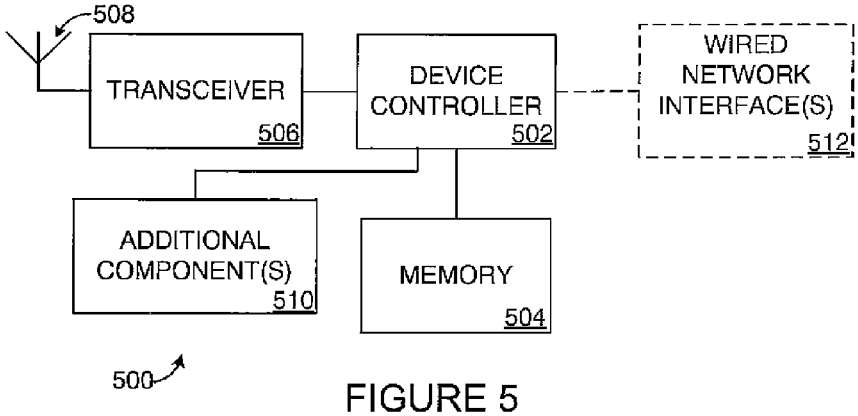
FIG. 5 illustrates an example wireless node in a process control system or other system according to this disclosure.

FIG. 5 illustrates an example wireless node 500 in a process control system or other system according to this disclosure. The wireless node 500 could, for example, represent a leaf node, infrastructure node, or gateway infrastructure node in the system 400 of FIG. 4 or other system.

As shown in FIG. 5, the node 500 includes a device controller 502. The controller 502 controls the overall operation of the node 500. For example, the controller 502 may receive or generate data to be transmitted externally, and the controller 502 could provide the data to one or more other components in the node 500 for transmission over a wired or wireless network. The controller 502 could also receive data over a wired or wireless network and use or pass on the data.

As particular examples, the controller 502 in a sensor leaf node could provide sensor data for transmission, and the controller 502 in an actuator leaf node could receive and implement control signals (note that a leaf node could represent a combined sensor-actuator device). As another example, the controller 502 in an infrastructure node could receive data transmitted wirelessly, determine a next hop for the data (if any), and provide the data for transmission to the next hop (if any). As a third example, the controller 502 in a gateway infrastructure node could receive data from a wired network and provide the data for wireless transmission (or vice versa). The controller 502 could perform any other or additional functions to support the operation of the node 500.

The controller 502 includes any suitable hardware, software, firmware, or combination thereof for controlling the operation of the node 500. As particular examples, the controller 502 could represent a processor, microprocessor, microcontroller, field programmable gate array (FPGA), or other processing or control device.

A memory 504 is coupled to the controller 502. The memory 504 stores any of a wide variety of information used, collected, or generated by the node 500. For example, the memory 504 could store information received over one network that is to be transmitted over the same or different network. The memory 504 includes any suitable volatile and/or non-volatile storage and retrieval device or devices.

The node 500 also includes one or more wireless transceivers 506 coupled to one or more antennas 508. The transceiver(s) 506 and antenna(s) 508 can be used by the node 500 to communicate wirelessly with other devices. For example, in a leaf node, the transceiver(s) 506 and antenna(s) 508 can be used to communicate with infrastructure nodes. In an infrastructure node or gateway infrastructure node, the transceiver(s) 506 and antenna(s) 508 can be used to communicate with leaf nodes, other infrastructure nodes or gateway infrastructure nodes, or WiFi or other devices (such as wireless controllers or hand-held user devices. Each transceiver 506 may be coupled to its own antennas 508, or multiple transceivers 506 can share a common antenna 508. Each transceiver 506 includes any suitable structure for generating signals to be transmitted wirelessly and/or receiving signals received wirelessly. In some embodiments, each transceiver 506 represents an RF transceiver, although each transceiver could include a transmitter and a separate receiver. Also, each antenna 508 could represent an RF antenna (although any other suitable wireless signals could be used to communicate). Further, one or more of the ground patterns described and illustrated above could be used with the transceiver(s) 506 and antenna(s) 508.

One or more additional components 510 could be used in the node 500 depending on the implementation. For example, the additional components 510 could take sensor measurements in a sensor leaf node or adjust industrial equipment in an actuator leaf node. The additional components 510 could also represent mobile telephone or personal digital assistant (PDA) functionality in other mobile wireless devices. Any other additional components 510 could be used depending on the particular implementation.

If the node 500 represents a gateway infrastructure node, the node 500 may further include one or more wired network interfaces 512. The wired network interfaces 512 allow the node 500 to communicate over one or more wired networks, such as the network 406. Each wired network interface 512 includes any suitable structure for transmitting and/or receiving signals over a wired network, such as an Ethernet interface.

Although FIG. 5 illustrates one example of a wireless node 500 in a process control system or other system, various changes may be made to FIG. 5. For example, various components in FIG. 5 could be combined, subdivided, or omitted and additional components could be added according to particular needs. Also, in general, a "wireless node" may represent any device that can transmit and/or receive data wirelessly (even if the "wireless node" has the ability to transmit and/or receive data over a wired connection, as well).

Figure 6:
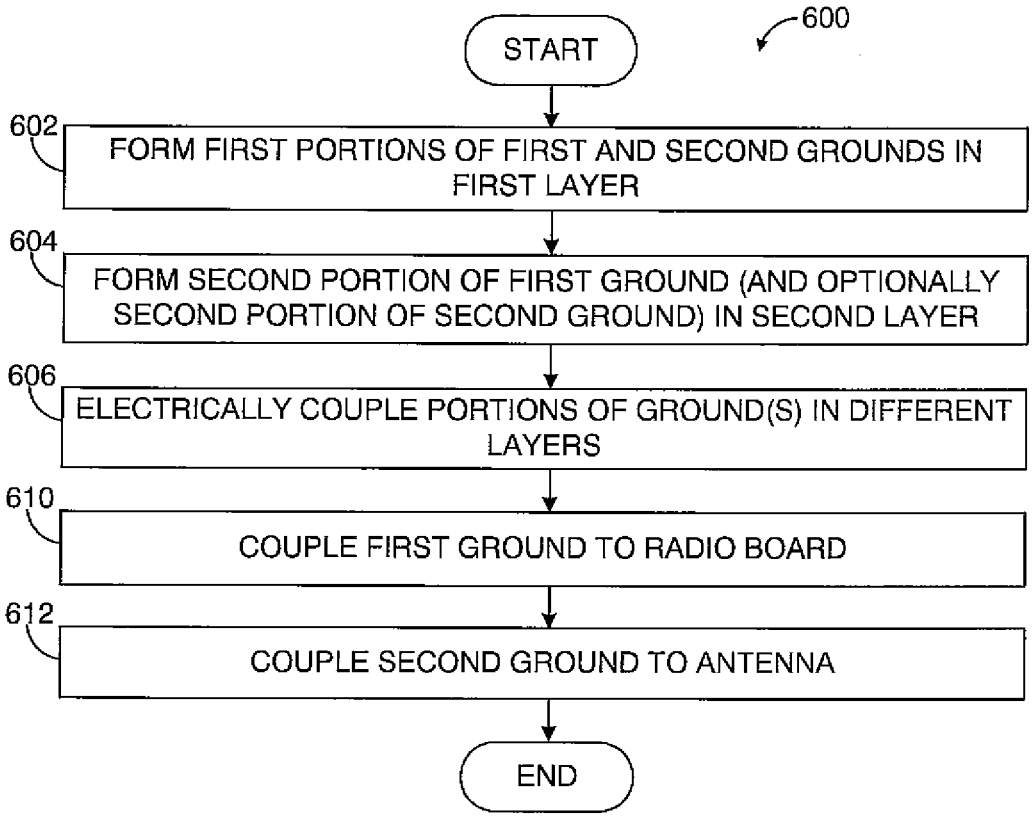
FIG. 6 illustrates an example method for providing isolated overlapping grounds in a wireless sensor or other wireless device according to this disclosure.

FIG. 6 illustrates an example method 600 for providing isolated overlapping grounds in a wireless sensor or other wireless device according to this disclosure. First portions of first and second grounds are formed in a first layer of a ground pattern at step 602. This could include, for example, forming a first portion of a radio board ground and a first portion of an antenna ground.

A second portion of the first ground is formed in a second layer of the ground pattern at step 604. This could include, for example, forming a second portion of the radio board ground. This step may optionally include forming a second portion of the second ground, such as a second portion of the antenna ground. The grounds at least partially overlap, meaning at least part of the antenna ground in one plane overlaps at least part of the radio board ground in another substantially parallel plane.

Portions of at least one of the grounds in different layers are electrically coupled at step 606. This could include, for example, forming conductive vias that electrically couple the portions of the radio board ground in different layers. This could also include forming conductive vias that electrically couple the portions of the antenna ground in different layers. The first ground is coupled to a radio board at step 608, and the second ground is coupled to an antenna at step 610.

Although FIG. 6 illustrates one example of a method 600 for providing isolated overlapping grounds in a wireless sensor or other wireless device, various changes may be made to FIG. 6. For example, while shown as a series of steps, various steps in FIG. 6 could overlap, occur in parallel, or occur in a different order.

It may be advantageous to set forth definitions of certain words and phrases used throughout this patent document. The term "couple" and its derivatives refer to any direct or indirect communication between two or more elements, whether or not those elements are in physical contact with one another. The terms "transmit," "receive," and "communicate," as well as derivatives thereof, encompass both direct and indirect communication. The terms "include" and "comprise," as well as derivatives thereof, mean inclusion without limitation. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, have a relationship to or with, or the like.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. An apparatus comprising:

a ground pattern comprising a radio board ground and an antenna ground;

wherein the radio board ground comprises a first portion in a first layer of the ground pattern and a second portion in a second layer of the ground pattern;

wherein the antenna ground comprises a first portion in the first layer of the ground pattern and a second portion in the second layer of the ground pattern; and wherein at least part of the second portion of the radio board ground and at least part of the first portion of the antenna ground overlap.

2. The apparatus of claim 1, wherein the second portion of the antenna ground comprises at least one projection from the first portion of the antenna ground.

3. The apparatus of claim 2, wherein the second portion of the radio board ground defines (i) a channel containing a signal trace configured to couple a wireless radio board and an antenna and (ii) a cavity into which the at least one projection projects.

4. The apparatus of claim 3, wherein the radio board ground and the antenna ground are separated by at least approximately 0.5 mm.

5. The apparatus of claim 1, wherein at least part of the first portion of the radio board ground and at least part of the second portion of the antenna ground overlap.

6. The apparatus of claim 5, wherein:

the second portion of the radio board ground comprises multiple strips each overlapping both the first portion of the radio board ground and the first portion of the antenna ground; and the second portion of the antenna ground comprises multiple strips each overlapping both the first portion of the radio board ground and the first portion of the antenna ground.

7. The apparatus of claim 6, wherein:

the strips forming the second portion of the radio board ground are located between the strips forming the second portion of the antenna ground; and a signal trace configured to couple a wireless radio board and an antenna is located between the strips forming the second portion of the radio board ground.

8. The apparatus of claim 5, wherein the radio board ground and the antenna ground are separated by at least approximately 3.0 mm.

9. A system comprising:

a wireless radio board;

an antenna; and a ground pattern comprising a radio board ground and an antenna ground;

wherein the radio board ground comprises a first portion in a first layer of the ground pattern and a second portion in a second layer of the ground pattern;

wherein the antenna ground comprises a first portion in the first layer of the ground pattern and a second portion in the second layer of the ground pattern; and wherein at least part of the second portion of the radio board ground and at least part of the first portion of the antenna ground overlap.

10. The system of claim 9, wherein the second portion of the antenna ground comprises at least one projection from the first portion of the antenna ground.

11. The system of claim 10, wherein the second portion of the radio board ground defines (i) a channel containing a signal trace coupling the wireless radio board and the antenna and (ii) a cavity into which the at least one projection projects.

12. The system of claim 11, wherein the radio board ground and the antenna ground are separated by at least approximately 0.5 mm.

13. The system of claim 9, wherein at least part of the first portion of the radio board ground and at least part of the second portion of the antenna ground overlap.

14. The system of claim 13, wherein:

the second portion of the radio board ground comprises multiple strips each overlapping both the first portion of the radio board ground and the first portion of the antenna ground; and the second portion of the antenna ground comprises multiple strips each overlapping both the first portion of the radio board ground and the first portion of the antenna ground.

15. The system of claim 14, wherein:

the strips forming the second portion of the radio board ground are located between the strips forming the second portion of the antenna ground; and a signal trace coupling the wireless radio board and the antenna is located between the strips forming the second portion of the radio board ground.

16. The system of claim 13, wherein the radio board ground and the antenna ground are separated by at least approximately 3.0 mm.

17. A method comprising:

forming a radio board ground in a ground pattern; and forming an antenna ground in the ground pattern;

wherein forming the radio board ground comprises forming a first portion in a first layer of the ground pattern and a second portion in a second layer of the ground pattern;

wherein forming the antenna ground comprises forming a first portion in the first layer of the ground pattern and a second portion in the second layer of the ground pattern; and wherein at least part of the second portion of the radio board ground and at least part of the first portion of the antenna ground overlap.

18. The method of claim 17, wherein the second portion of the antenna ground comprises at least one projection from the first portion of the antenna ground.

19. The method of claim 17, wherein at least part of the first portion of the radio board ground and at least part of the second portion of the antenna ground overlap.

20. The method of claim 19, wherein:

forming the second portion of the radio board ground comprises forming multiple strips each overlapping both the first portion of the radio board ground and the first portion of the antenna ground;

forming the second portion of the antenna ground comprises forming multiple strips each overlapping both the first portion of the radio board ground and the first portion of the antenna ground; and the strips forming the second portion of the radio board ground are located between the strips forming the second portion of the antenna ground.

* * * * *